United States Patent [19]

Kobayashi

[11] 4,422,906

[45] Dec. 27, 1983

[54] PROCESS FOR DIRECT GOLD PLATING OF STAINLESS STEEL

[76] Inventor: Masami Kobayashi, 3-13-15, Hachimanyama, Setagaya-ku, Tokyo, Japan

[21] Appl. No.: 303,175

[22] Filed: Sep. 17, 1981

[51] Int. Cl.[3] ..... C25D 5/36

[52] U.S. Cl. ..... 204/34; 204/46 G

[58] Field of Search ..... 204/34, 145 R, 46 G

[56] References Cited

U.S. PATENT DOCUMENTS

| | | | |
|---|---|---|---|
| 2,133,996 | 10/1938 | Underwood | 204/12 |
| 3,066,084 | 11/1962 | Osterman, Jr. et al. | 204/144 |
| 3,654,099 | 4/1972 | De Bruyne | 204/29 |

*Primary Examiner*—G. L. Kaplan
*Assistant Examiner*—William Leader
*Attorney, Agent, or Firm*—Armstrong, Nikaido, Marmelstein & Kubovcik

[57] ABSTRACT

Stainless steel can be directly plated with gold by a process wherein stainless steel is dipped in an activating solution; the activated stainless steel is subjected to cathodic electrolysis in a cathode electrolytic activation solution and then the treated stainless steel is directly plated with gold. A preferable activating solution contains (i) 3–20 wt. % of HCl, (ii) 2–30 wt. % of $H_2SO_4$, (iii) 0.1–5 wt. % of a nonionic or cationic surfactant and (iv) 0.1–20 wt. % of 2-pyrrolidone or N-alkyl-2-pyrrolidone. A preferable cathode electrolytic activation solution contains (i) 5–20 wt. % of $H_3PO_4$, (ii) 2–10% $HNO_3$, (iii) 0.1–5 wt. % of a nonionic or cationic surfactant and (iv) 0.1–20 wt. % of 2-pyrrolidone or N-alkyl-2-pyrrolidone.

13 Claims, No Drawings

PROCESS FOR DIRECT GOLD PLATING OF STAINLESS STEEL

BACKGROUND OF THE INVENTION

1. Field of the Invention

The present invention relates to a process for plating stainless steel directly with gold, by which a gold plating excellent in adhesion, appearance and corrosion resistance can directly be formed on the stainless steel without corrosion of the metal texture of the stainless steel.

2. Description of the Prior Art

For gold plating of stainless steel, cleaning and activation are indispensable as preliminary treatments as in the case of gold plating of ordinary metals. Furthermore, in the case of gold plating of stainless steel, it is necessary to completely remove a special passive state film present on the surface of the stainless steel.

Even if this passive state film is removed by an acid solution, this film is readily formed again on the surface of the stainless steel in water or air and the adhesion of the formed plating is degraded by this passive state film. Therefore, it is indispensable to prevent re-formation of this passive state film during the steps between the activating treatment and the plating operation.

One of main causes of re-formation of a passive state film is that when a stainless steel is washed with water after the activating treatment, water flows down from the surface of the stainless steel and a phenomenon of so-called "water breaks" takes place, which renders the surface or the stainless steel dry. Accordingly, it also is necessary to prevent occurrence of this undesirable phenomenon.

A passive state film formed on the surface of stainless steel is not composed of a simple metal oxide but is an amorphous film composed of an alloy of chromium and iron, which has properties similar to those of glass. Moreover, this film is very thin and the thickness is ordinarily in the range of from 30 to 50 Å.

This film exerts a peculiar anticorrosion effect on stainless steel, and the film impedes the plating operation. Accordingly, even if a stainless steel is subjected to a surface-activating treatment applied to ordinary metals such as copper and iron, it is impossible to form a good plating on the surface of the stainless steel.

Various research experiments have heretofore been made on methods of gold plating of stainless steel, but a good method for direct gold plating of stainless steel has not been developed. The following two methods are now adopted for gold plating of stainless steel despite various defects involved therein.

According to the first method, as pickling solution is formed by mixing an acid solution comprising hydrochloric acid or sulfuric acid alone or a mixture thereof at a high concentration with an other organic or inorganic acid, a stainless steel is dipped in the so formed pickling solution at a high temperature of 70° to 90° C. to effect activation, and then, the activated stainless steel is subjected to electroless copper plating, nickel plating and finally gold plating (triple-plating method) or the activated stainless steel is subjected to electrolytic or electroless nickel plating and finally gold plating (double-plating method).

According to the second method, a stainless steel is subjected to cathode electrolytic activation using a mixed acid comprising 30 to 40% by weight of hydrochloric acid and 1 to 7% by weight of hydrofluoric acid to effect activation and then, the activated stainless steel is directly plated with gold.

These two methods, however, have unavoidable defects in common. Since a strong acid is used for activation, a passive state film present on the surface of a stainless steel can be removed, but also the texture of the stainless steel is corroded by such strong acid. This over-pickling phenomenon is especially conspicuous in the second method since hydrofluoric acid is used, and the mirror-polished surface of the stainless steel is clouded and the surface appearance is degraded.

When a stainless steel having the surface thus roughened is subjected to gold plating, the plated surface becomes cloudy and a beautiful gloss plating cannot be obtained. Furthermore, this surface roughening results in formation of pinholes on the plated surface, and such defects as reduction of the corrosion resistance and acceleration of rusting arise.

When an ultrafine stainless steel wire for an electronic device part or the like is plated with gold, the wire diameter is reduced and made irregular by over-pickling, and a stainless steel wire having a diameter of about 10 μm is liable to be dissolved out by excessive activation.

As is seen from the foregoing description, conspicuous over-pickling takes place in a stainless steel if strong acid dipping or cathode electrolytic activation is used. This is due to the selective corrosion of chromium in a stainless alloy by the acid solution. More specifically, chromium molecules are dissolved out from the steel surface to roughen the surface.

When stainless steel is subjected to under-plating with nickel (the plating layer has a high hardness and is poor in ductility), cracks are readily formed on the nickel layer upon bending, and also the top layer of gold is cracked by cracking of the nickel under-plating layer, resulting in drastic reduction of the electric conductivity and corrosion resistance. When the plated stainless steel is used for an electronic device part, the properties of an electronic device are adversely influenced by the magnetic characteristic of nickel. Therefore, nickel under-plating is not preferred.

I did research with a view to developing an excellent gold plating process capable of forming a gold plating layer on stainless steel without roughening the surface of the stainless steel or degrading of the mirror-polished surface and also without reducting the diameter in the case of an ultrafine stainless steel wire, while eliminating the foregoing defects of the conventional gold-plating techniques, and I have now completed the present invention.

Ideal conditions for direct gold plating of a stainless steel are as follows. First of all, only a very thin passive state film formed on the surface of the stainless steel is removed while preventing intrusion of acids into the texture of the stainless steel and thus inhibiting selective corrosion of chromium. In the second place, even if water washing is carried out after the activating treatment, occurrence of an undesirable phenomenon of water breaks is effectively prevented and a completely activated state is produced on the surface of the stainless steel. In the third place, this completely activated state can be maintained until the stainless steel is subjected to the gold plating operation. If these conditions are satisfied, direct gold plating of stainless steels will ideally be accomplished.

SUMMARY OF THE INVENTION

A primary object of the present invention is to provide a process for direct gold plating of a stainless steel wherein the above-mentioned ideal conditions are achieved.

I have found that dipping in a specific pickling solution and activation by a specific cathode electrolytic activation solution are effective as pre-treatments for realizing the above-mentioned ideal gold plating and excellent results can be obtained by adoption of a gold plating process including these two pre-treatment steps.

In accordance with the present invention, there is provided a process for direct gold plating of stainless steels which comprises the steps of:

dipping a stainless steel in an activating solution;

subjecting the activated stainless steel to cathode electrolytic activation; and then, electroplating the cathodically electrolyzed stainless steel with gold.

DESCRIPTION OF THE PREFERRED EMBODIMENTS

The activating solution used in the first step is preferably an aqueous mixed acid solution containing, based on the weight of the solution:

(i) 3 to 20% by weight of hydrochloric acid, (ii) 2 to 30% by weight of sulfuric acid, (iii) 0.1 to 5% by weight of a nonionic or cationic surface active agent and (iv) 0.1 to 20% by weight of 2-pyrrolidone or its N-alkyl derivative.

More preferably, the activating solution used in the first step is an aqueous mixed acid solution containing, based on the weight of the solution:

(i) 3 to 10% by weight of hydrochloric acid, (ii) 0.5 to 4% by weight of nitric acid, (iii) 2 to 15% by weight of sulfuric acid, (iv) 1 to 5% by weight of acetic acid, (v) 3 to 10% by weight of citric acid, (vi) 0.1 to 3% by weight of a nonionic or cationic surface active agent, (vii) 0.1 to 10% by weight of 2-pyrrolidone or its N-alkyl derivative and (viii) 1 to 5% by weight of an acetylenic glycol.

In the activating solution used in the present invention, by using specific amounts of hydrochloric acid, sulfuric acid, a nonionic or cationic surface active agent and 2-pyrrolidone or its N-alkyl derivative, there can be attained a synergistic effect of activating the surface of a stainless steel.

If the amount of hydrochloric acid is smaller than 3% by weight, no substantial activating effect can be obtained, and if the amount of hydrochloric acid is larger than 20% by weight, over-pickling occurs.

If the amount of sulfuric acid is smaller than 2% by weight, no substantial activating effect can be attained, and if the amount of sulfuric acid is larger than 30% by weight, over-pickling occurs.

I did research with a view to developing a method of preventing the occurrence of the phenomenon of water breaks at the step of water washing of the activated stainless steel by using various surface active agents. I have found that nonionic or cationic surface active agents show a certain effect and if an acetylenic glycol is used in addition to this surface active agent, there can be attained a synergistic effect of preventing occurrence of water breaks at the step of water washing of the activated strainless steel. If this mixture is used, water is left on the entire surface of the stainless steel and a good activated state can be maintained until the stainless steel is subjected to the gold plating operation. If the amount of the nonionic or cationic surface active agent is smaller than 0.1% by weight, it is impossible to reduce the surface tension of the activating solution to the desired value, i.e., 30 dyne/cm or lower, and this surfactant need not be incorporated in an amount exceeding 5% by weight. The nonionic surface active agent used includes, for example, polyoxyethylene alkyl ethers such as polyoxyethylene lauryl ether. The cationic surface active agent includes, for example, perfluoroalkyl trimethylammonium salts. Among these nonionic and cationic surface active agents, nonionic surface active agents are preferable.

It is considered that 2-pyrrolidone or its N-alkyl derivative exerts a function of assuredly removing the passive state film and surface oxide dissolved in the mixed acid by virtue of excellent dissolving and washing powers thereof. It also exerts a function of assisting the acetylenic glycol's effect of preventing surface clouding. If the amount of 2-pyrrolidone or its N-alkyl derivative is smaller than 0.1% by weight, the washing effect and the effect of assisting the clouding prevention cannot be attained, and if 2-pyrrolidone or its N-alkyl derivative is incorporated in an amount exceeding 20% by weight, a large quantity of heat is generated at the time of incorporation and 2-pyrrolidone or its N-alkyl derivative is wastefully consumed. As the N-alkyl derivative of 2-pyrrolidone, those which have an alkyl group of 1 to 5 carbon atoms, are used. Preferable N-alkyl derivatives are N-ethyl-2-pyrrolidone and N-methyl-2-pyrrolidone.

Nitric acid has a function of forming a passive state film on a stainless steel, and it is admitted to a concentrated nitric acid solution having a concentration of about 30% may be used for formation of a passive state film on the surface of a stainless steel which has been subjected to, for example, cutting processing. From the results of experiments made by me, it has been found that if a small quantity of nitric acid is incorporated into a pickling solution, it exerts an auxiliary function in removing only a passive state film formed on the surface of a stainless steel. A preferable amount of nitric acid is in the range of from 0.5 to 4% by weight.

If the amount of acetic acid is smaller than 1% by weight, the activating effect is low, and if acetic acid is incorporated in an amount larger than 5% by weight, no substantial increase of the activating effect can be obtained and acetic acid need not be incorporated in too large an amount.

If the amount of citric acid is smaller than 3% by weight, the activating effect is low, and if citric acid is incorporated in an amount larger than 10% by weight, no substantial increase of the activating effect can be attained.

It is known that 2-butyne-1,4-diol can be added as a brightner in an amount of 0.1 l to 0.6 g/l to a bright nickel plating solution. It has been found that if acetylenic glycol such as 2-pentyne-1,4-diol or 2-butyne-1,4-diol is incorporated into the above-mentioned activating solution, there can be attained not only the above-mentioned synergistic effect with the nonionic surface active agent but also an effect of protecting the surface of the stainless steel from corrosion of the texture by the pickling solution which has dissolved away and removed the passive state film on the surface of the stainless steel.

An acetylenic glycol is defective in that it is readily precipitated to cause clouding. From the results of experiments made by me repeatedly for a long time, it has been found that this clouding can be prevented by incorporation of 2-pyrrolidone or its N-alkyl derivative. Therefore, it has been confirmed that the treating solutions of the present invention are very stable and excellent in the operation adaptability, and they can effectively be used for a long time and are excellent from an economical viewpoint. A preferable amount of the acetylenic glycol is in the range of from 1 to 5% by weight. As the acetylenic glycol, 2-pentyne-1,4-diol and 2-butyne-1,4-diol are preferably used.

The activation treatment may be carried out by dipping the stainless steel in the activating solution at a normal temperature for 30 seconds to 7 minutes. It is more preferable that the activation treatment is carried out under irradiation with ultrasonic waves.

The activated stainless steels are then subjected to cathode electrolytic activation. The cathode electrolytic activation solution used in this step is preferably an aqueous mixed acid solution containing, based on the weight of the solution:

(i) 5 to 20% by weight of phosphoric acid,
(ii) 2 to 10% by weight of nitric acid,
(iii) 0.1 to 5% by weight of a nonionic surface active agent and
(iv) 0.1 to 20% by weight of 2-pyrrolidone or its N-alkyl(C1~5)-derivative.

More preferably, the solution used in the cathode electrolytic activation step is an aqueous mixed acid solution containing, based on the weight of the solution:

(i) 5 to 10% by weight of phosphoric acid,
(ii) 2 to 10% by weight of citric acid,
(iii) 1 to 5% by weight of oxalic acid,
(iv) 2 to 5% by weight of nitric acid,
(v) 3 to 20%, especially 3 to 10%, by weight of sulfuric acid,
(vi) 0.1 to 3% by weight of a nonionic or cationic surface active agent,
(vii) 0.5 to 10% , especially 0.5 to 5%, by weight of gluconic acid,
(viii) 0.1 to 10% by weight of 2-pyrrolidone or its N-alkyl(C1~5) derivative and
(ix) 1 to 5% by weight of an acetylenic glycol.

In the cathode electrolytic activating solution of the present invention, by using specific amounts of phosphoric acid, nitric acid, a nonionic or cationic surface active agent and 2-pyrrolidone or its N-alkyl derivative, there can be attained an excellent synergistic cathode electrolytic activating effect.

If the amount of phosphoric acid is smaller than 5% by weight, no substantial cathode electrolytic activating effect can be attained, and if the amount of phosphoric acid exceeds 20% by weight, no substantial increase of the effect can be obtained.

If the amount of nitric acid is smaller than 2% by weight, the cathode electrolytic activating effect is low, and if nitric acid is incorporated in an amount exceeding 10% by volume, a passive state film is formed on the surface of a stainless steel and there arises a risk of plating failure.

When the amount of the nonionic or cationic surface active agent is smaller than 0.1% by weight, it is impossible to reduce the surface tension of the cathode electrolytic activating solution to the desired value, i.e., 30 dyne/cm or lower, and it is not necessary to use the surfactant in an amount exceeding 5% by weight. The nonionic surface active agents and the cationic surface active agents used include those which are hereinbefore mentioned with respect to the activating solution used in the first step. In general, the nonionic surface active agents are more preferable than the cationic surface active agents.

If the amount of 2-pyrrolidone or its N-alkyl derivative is smaller than 0.1% by weight, the washing effect and the effect of preventing clouding by an acetylenic glycol cannot be attained, and if the amount of 2-pyrrolidone or its N-alkyl derivative is larger than 20% by weight, a large quantity of heat is generated at the time of incorporation and 2-pyrrolidone or its N-alkyl derivative is wastefully consumed.

If the amount of citric acid is smaller than 2% by weight, the cathode electrolytic activating effect is low, and if citric acid is incorporated in an amount exceeding 10% by weight, no substantial increase of the cathode electrolytic activating effect can be obtained.

If the amount of oxalic acid is smaller than 1% by weight, the cathode electrolytic activating effect is low, and if oxalic acid is incorporated in an amount exceeding 5% by weight, a saturation state is produced and a crystal is formed. Accordingly, it is not permissible to incorporate oxalic acid in too large an amount.

If the amount of sulfuric acid is smaller than 3% by weight, the cathode electrolytic activating effect is low, and if sulfuric acid is incorporated in an amount exceeding 20% by weight, over-pickling occurs.

If the amount of gluconic acid is smaller than 0.5% by weight, the cathode electrolytic activating effect is low, and if the amount of gluconic acid is larger than 10% by weight, no substantial increase of the cathode electrolytic activating effect can be obtained and clouding is readily caused.

If the amount of the acetylenic glycol is smaller tnan 1% by weight, the effect of improving the wetting property of the surface of the stainless steel after the cathode electrolytic activating treatment is low. If the amount of the acetylenic glycol is larger than 5% by weight, it clouds the cathode electrolytic activating solution. Accordingly, it is not permissible to incorporate the acetylenic glycol in too large an amount.

At the cathode electrolytic activation step, electrolysis may be carried out at a normal temperature at a cathode current density of 1 to 7 $A/dm^2$ for 30 seconds to 5 minutes by using a platinum-coated titanium anode and the stainless steel as the cathode Times of duration of the completed activated state were examined by experiments. It has been found that if the stainless steel is dipped in pure water for about 30 minutes or allowed to stand still in air for about 10 minutes after the above-mentioned activating treatment, re-formation of a passive state film or surface oxide on the activated surface of the stainless steel is not caused. Furthermore, it has been found that if the stainless steel is subjected to gold plating within the above-mentioned standing time, a gold plating excellent in adhesion and uniformity can be obtained.

The stainless steel treated as mentioned above may be directly electroplated with gold. The electroplating procedure may be conventional. In general, the electroplating can be carried out by using an electroplating solution containing about 100 g/l of citric acid, about 100 g/l of sodium citrate, about 20 g/l of nickel sulfamate and about 5 g/l of potassium cyanide and maintained at 40° C. The initial current density may be about 5 A/dm.

The present invention will now be described in detail with reference to the following Examples that by no means limit the scope of the present invention.

EXAMPLE 1

An activating solution having the following composition was prepared:

Hydrochloric acid (35% solution): 8% by volume
Nitric acid (68% solution): 2.5% by volume
Sulfuric acid (75% solution): 6% by volume
Acetic acid (90% solution): 2% by volume
Citric acid (crystal): 5% by weight
Polyoxyethylene alkyl ether surfactant (Liponox N-105 supplied by Lion Yushi K.K.): 2% by weight
N-Ethyl-2-pyrrolidone: 3% by weight
2-Pentyne-1,4-diol: 2% by weight Namely, a mixed acid solution formed by incorporating and dissolving the above components in the above-mentioned order was used as the activating solution.

A cathode electrolytic activation solution having the following composition was prepared:

Phosphoric acid (85% solution): 20% by volume
Citric acid: 5% by weight
Oxalic acid: 3% by weight
Nitric acid (68% solution): 5% by volume
Sulfuric acid (75% solution): 5% by volume
Polyoxyethylene alkyl ether surfactant: 2% by weight
Gluconic acid (50% solution): 10% by volume
N-Ethyl-2-pyrrolidone: 5% by weight
2-Pentyne-1,4-diol: 3% by weight Namely, a mixed acid solution formed by incorporating and dissolving the above components in the above-mentioned order was used as the cathode electrolytic activation solution.

A hoop of SAS 304 stainless steel having a thickness of 0.2 mm and a width of 21 mm was treated according to the following procedures by the continuous wind-up method and was then plated with gold.

The stainless steel hoop was degreased according to a known method, and the degreased hoop was dipped in the above-mentioned activating solution at room temperature for 2 minutes under irradiation with ultrasonic waves to effect activation of the first step. The hoop was washed with water and was then subjected to an electrolytic treatment in the above-mentioned cathode electrolytic activation solution for 3 minutes at a cathode current density of 5 A/dm$^2$ by using a platinum-coated titanium plate as the anode and the stainless steel hoop as the cathode to activate the surface of the stainless steel hoop. The activated hoop was washed with water and immediately plated with gold by using a known acidic gold plating solution (citric acid solution). Thus, a stainless steel hoop having a gold plating layer having a thickness of 0.3$\mu$ was prepared in a continuous manner. This gold-plated stainless steel hoop was excellent in gloss, adhesion, solderability, electric conductivity and corrosion resistance, and it was found that this plated stainless steel hoop could effectively be used as an electronic industrial material.

EXAMPLE 2

An ultrafine stainless steel wire having a diameter of 30$\mu$ was continuously treated with the activating and cathode electrolytic activation solutions prepared in Example 1 according to the following procedures and was then plated with gold to obtain a gold-plated stainless steel wire.

The stainless steel wire was degreased according to a known method, and the degreased stainless steel wire was dipped in and passed through the activating solution for a residence time of 1 minute at room temperature. Then, the wire was washed with water and subjected to cathodic electrolysis in the cathode electrolytic activation solution at a cathode current density of 3 A/dm$^2$ for 1 minute to activate the surface. Then, the activated stainless steel wire was washed with water and plated with gold by using a known acidic gold plating solution to obtain a gold-plated stainless steel fine wire having a gold plating layer having a thickness of 0.5$\mu$. This gold-plated stainless steel wire was excellent in adhesion, gloss, solderability, electric conductivity and corrosion resistance, and it was found that this plated stainless wire could effectively be used as a lead-in wire for an electric element instead of a gold wire.

As will be apparent from the foregoing description and Examples, according to the present invention, direct gold plating of a stainless steel, which has been difficult by the conventional techniques, can advantageously be accomplished by using the above-mentioned specific activating and cathode electrolytic activation solutions, and a gold-plated stainless steel material excellent in various properties such as gloss, adhesion, solderability, electric conductivity and corrosion resistance can be provided.

The gold-plated stainless steel products prepared by the process of the present invention are used, for example, as lead wires for electrical elements, hoops for electronic devices, decorative fibers and electrical discharge machining wires for cutting wires.

I claim:

1. A process for direct gold plating of stainless steel which comprises the steps of:

dipping stainless steel in an activating solution which is an aqueous mixed acid solution containing, based on the weight of the solution,
(i) 3% to 20% by weight of hydrochloric acid,
(ii) 2 to 30% by weight of sulfuric acid,
(iii) 0.1 to 5% by weight of a nonionic or cationic surface active agent, and
(iv) 0.1 to 20% by weight of a compound selected from the group consisting of 2-pyrrolidone and N-alkyl-2-pyrrolidone, the alkyl moiety having 1 to 5 carbon atoms;

subjecting the activated stainless steel to cathodic electrolysis in a cathode electrolytic activation solution: and then electroplating the cathodically electrolyzed stainless steel with gold.

2. A process for direct gold plating of stainless steel according to claim 1, wherein the activating solution used in the first step is an aqueous mixed acid solution containing, based on the weight of the solution;

(i) 3 to 10% by weight of hydrochloric acid,
(ii) 0.5 to 4% by weight of nitric acid,
(iii) 2 to 15% by weight of sulfuric acid,
(iv) 1 to 5% by weight of acetic acid,
(v) 3 to 10% by weight of citric acid,
(vi) 0.1 to 3% by weight of a nonionic or cationic surface active agent,
(vii) 0.1 to 10% by weight of a compound selected from the group consisting of 2-pyrrolidone and N-alkyl-2-pyrrolidone, the alkyl moiety having 1 to 5 carbon atoms, and (viii) 1 to 5% by weight of an acetylenic glycol.

3. A process for direct gold plating of stainless steel according to claim 1 or 2, wherein the nonionic surface active agent contained in the activating solution used in the first step is polyoxyethylene alkyl ether.

4. A process for direct gold plating of stainless steel according to claim 1 or 2, wherein the N-alkyl-2-pyrrolidone contained in the activating solution used in the first step is N-methyl-2-pyrrolidone or N-ethyl-2-pyrrolidone.

5. A process for direct gold plating of stainless steel according to claim 2, wherein the acetylenic glycol contained in the activating solution used in the first step is 2-pentyne-1,4-diol or 2-butyne-1,4-diol.

6. A process for direct gold plating of stainless steel according to claim 1, wherein the cathode electrolytic activation solution used in the cathodically electrolyzing step is an aqueous mixed acid solution containing, based on the weight of the solution:

(i) 5 to 20% by weight of phosphoric acid, (ii) 2 to 10% by weight of nitric acid, (iii) 0.1 to 5% by weight of a nonionic surface active agent and (iv) 0.1 to 20% by weight of a compound selected from the group consisting of 2-pyrrolidone and N-alkyl-2-pyrrolidone, the alkyl moiety having 1 to 5 carbon atoms.

7. A process for direct gold plating of stainless steel according to claim 1, wherein the cathode electrolytic activation solution used in the cathodically electrolyzing step is an aqueous mixed acid solution containing, based on the weight of the solution:

(i) 5 to 10% by weight of phosphoric acid, (ii) 2 to 10% by weight of citric acid, (iii) 1 to 5% by weight of oxalic acid, (iv) 2 to 5% by weight of nitric acid, (v) 3 to 20% by weight of sulfuric acid, (vi) 0.1 to 3% by weight of a nonionic or cationic surface active agent, (vii) 0.5 to 10% by weight of gluconic acid, (viii) 0.1 to 10% by weight of a compound selected from the group consisting of 2-pyrrolidone and N-alkyl-2-pyrrolidone, the alkyl moiety having 1 to 5 carbon atoms.

(ix) 1 to 5% by weight of an acetylenic glycol.

8. A process for direct gold plating of stainless steel according to claim 6 or 7, wherein the nonionic surface active agent contained in the cathode electrolytic activation solution is polyoxyethylene alkyl ether.

9. A process for direct gold plating of stainless steel according to claim 6 or 7, wherein the N-alkyl-2-pyrrolidone contained in the cathode electrolytic activation solution is N-methyl-2-pyrrolidone or N-ethyl-2-pyrrolidone.

10. A process for direct gold plating of stainless steel according to claim 6 or 7, wherein the acetylenic glycol contained in the cathode electrolytic activation solution is 2-pentyne-1,4-diol or 2-butyne-1,4-diol.

11. A process for direct gold plating of stainless steel according to any one of claims 1 or 2, wherein at the first activating step, the stainless steel is dipped in the activating solution at room temperature for 30 seconds to 7 minutes.

12. A process for direct gold plating of stainless steel according to claim 11, wherein the dipping treatment of the activating step is carried out under irradiation with ultrasonic waves.

13. A process for direct gold plating of stainless steel according to any one of claims 1, 6 and 7, wherein at the cathodically electrolyzing step, electrolysis is carried out at a cathode current density of 1 to 7 $A/dm^2$ for 30 seconds to 5 minutes by using a platinum coated titanium anode and the stainless steel as the cathode.

* * * * *